US008461950B2

(12) United States Patent
Lim

(10) Patent No.: US 8,461,950 B2
(45) Date of Patent: Jun. 11, 2013

(54) ELECTROMAGNETIC SWITCHING DEVICE

(75) Inventor: Soo Hyun Lim, Jinju-si (KR)

(73) Assignee: LSIS Co., Ltd., Anyang-Si, Gyeonggi-Do (KR)

( * ) Notice: Subject to any disclaimer, the term of this patent is extended or adjusted under 35 U.S.C. 154(b) by 0 days.

(21) Appl. No.: 13/272,132

(22) Filed: Oct. 12, 2011

(65) Prior Publication Data

US 2012/0092095 A1 Apr. 19, 2012

(30) Foreign Application Priority Data

Oct. 15, 2010 (KR) ..... 10-2010-0100887

(51) Int. Cl.
*H01H 67/02* (2006.01)

(52) U.S. Cl.
USPC ..... 335/126; 335/131

(58) Field of Classification Search
USPC ..... 335/126, 131
See application file for complete search history.

(56) References Cited

U.S. PATENT DOCUMENTS

| | | | | |
|---|---|---|---|---|
| 2,649,521 | A * | 8/1953 | Cobb et al. | 335/162 |
| 2,692,314 | A * | 10/1954 | Lawrence | 335/129 |
| 2,794,093 | A * | 5/1957 | Morschel | 335/131 |
| 2,844,682 | A * | 7/1958 | Furnas | 335/162 |
| 2,851,646 | A * | 9/1958 | Williamson et al. | 318/755 |
| 2,855,482 | A * | 10/1958 | Cobb et al. | 335/189 |
| 2,933,573 | A * | 4/1960 | Strider | 335/126 |
| 2,951,133 | A * | 8/1960 | Davies et al. | 335/154 |
| 3,076,075 | A * | 1/1963 | Colvill | 335/126 |
| 3,194,920 | A * | 7/1965 | Scheib, Jr. | 335/131 |
| 3,225,159 | A * | 12/1965 | Myrent et al. | 335/126 |
| 3,334,319 | A * | 8/1967 | Herrmann et al. | 335/131 |
| 3,354,415 | A * | 11/1967 | Gribble et al. | 335/131 |
| 3,781,500 | A | 12/1973 | Grunert | |
| 4,213,108 | A * | 7/1980 | Gross | 335/131 |
| 4,506,242 | A * | 3/1985 | Karpe et al. | 335/120 |
| 4,907,464 | A * | 3/1990 | Isozumi | 74/7 A |
| 4,990,874 | A * | 2/1991 | Shiroyama | 335/126 |
| 5,039,967 | A * | 8/1991 | Morishita et al. | 335/131 |
| 5,546,061 | A * | 8/1996 | Okabayashi et al. | 335/78 |
| 5,679,935 | A * | 10/1997 | Baba et al. | 200/17 R |
| 5,917,394 | A * | 6/1999 | Fuchs | 335/229 |
| 6,700,466 | B1 * | 3/2004 | Yamamoto et al. | 335/132 |
| 2002/0135447 | A1 | 9/2002 | Gruner | |

FOREIGN PATENT DOCUMENTS

| | | |
|---|---|---|
| JP | U459239 | 4/1970 |
| JP | 4-12427 | 1/1992 |
| JP | 7235248 | 9/1995 |

OTHER PUBLICATIONS

Japan Patent Office Application Serial No. 2011-225729, Office Action dated Jan. 22, 2013, 4 pages.

* cited by examiner

*Primary Examiner* — Alexander Talpalatski
(74) *Attorney, Agent, or Firm* — Lee, Hong, Degerman, Kang & Waimey

(57) ABSTRACT

An electromagnetic switching device including: a housing; fixed contacts disposed in the housing; a movable contact which is brought into contact with the fixed contacts and separated from the fixed contacts; and a driving unit disposed at one side of the housing and driving the movable contact, wherein the fixed contacts are disposed to be perpendicular to a direction in which the movable contact moves. Thus, noise generation can be suppressed and external size can be reduced.

7 Claims, 8 Drawing Sheets

ELECTROMAGNETIC SWITCHING DEVICE

CROSS-REFERENCE TO RELATED APPLICATIONS

Pursuant to 35 U.S.C. §119(a), this application claims the benefit of earlier filing date and right of priority to Korean Patent Application No. 10-2010-0100887, filed on Oct. 15, 2010, the contents of which are hereby incorporated by reference herein in its entirety.

1. Field of the Invention

The present invention relates to an electromagnetic switching device and, more particularly, to an electromagnetic switching device capable of suppressing a generation of noise and reducing the size of an external appearance.

2. Description of the Related Art

As known, an electromagnetic switching device is a type of electrical contact opening and closing device for supplying or cutting current.

The electromagnetic switching device may be used in various industrial facilities, mechanics, vehicles, or the like.

In general, an electromagnetic switching device may be configured to include fixed contacts, a movable contact, and an electric actuator for driving the movable contact.

FIG. 1 is a sectional view of the related art electromagnetic switching device.

As shown in FIG. 1, the electromagnetic switching device 100 includes an arc extinguishing unit 100 and a driving unit 120.

The arc extinguishing unit 110 may include a fixed point contact 111 and a movable contact 112.

A housing 114 may be provided at an outer side of the fixed contacts 111 and the movable contact 112.

The driving unit 120 may include a coil 121 and a fixed core 122 and a movable core 123 which becomes close to or separated from each other.

The coil 121 may generate magnetic force when power is applied thereto.

The fixed core 122 and the movable core 123 may be disposed within the coil 121. One end portion of an operation rod 125 may be coupled to the movable core 123. The other end of the operation rod 125 may be connected to the movable contact 112 through the fixed core 122. A through hole 124 may be provided at the center of the fixed core 122 in order to allow the operation rod 125 to pass therethrough. A contact spring 113 may be provided on the operation rod 125 to allow the movable contact 112 and the fixed contacts 111 to be brought into contact, with a certain contact pressure.

A yoke plate 127 and a yoke body 128 forming a magnetic path along with the fixed core 122 and the movable core 123 may be provided in the vicinity of the coil 121.

A spring 126 may be provided between the fixed core 122 and the movable core 123. Accordingly, the movable core 123 may be separated from the fixed core 122.

The operation of the related art electromagnetic switching device 100 will be briefly described.

When power is applied to the coil 121, the coil 121 generates magnetic force.

The movable core 123 may move in a direction in which it approaches the fixed core 122. At the same time when the movable core 123 moves, the operation rod 125 moves, and the movable contact 122 may be brought into contact with the fixed contacts 111. The operation rod 125 may continuously move in the same direction even after it comes into contact with the fixed contacts 111. According to the movement of the operation rod 125, the contact spring 113 is compressed, and the movable contact 112 may pressurize the fixed contacts 111 so as to be brought into contact with the fixed contacts 111, with a certain contact pressure. Accordingly, the contact state between the movable contact 112 and the fixed contacts 111 can be stably maintained.

Meanwhile, when power supply to the coil is stopped, the generation of magnetic force may be stopped. When power supply to the coil 121 is stopped, the movable core 123 may be separated from the fixed core 122 by the elastic force of the spring 126. Accordingly, the movable contact can be separated from the fixed contacts 111.

However, in the related art electromagnetic switching device, since the fixed contacts 111 are coupled to the housing 114 along a direction in which the movable contacts 112 move, the size of the external appearance (or the height of the housing 114) in one direction, e.g., in the movement direction of the movable contacts 112, may increase.

Also, since the fixed contacts 111 are coupled to the housing 114 along a direction in which the movable contacts 112 move, when the movable contacts 112 are repeatedly brought into contact with the fixed contacts 111 (i.e., contact by impact), a gap may be formed between the fixed contacts 111 and the housing 114 or the fixed contacts 111 may be separated from the housing 114, shortening the life span.

SUMMARY OF THE INVENTION

An aspect of the present invention provides an electromagnetic switching device capable of reducing the size of an external appearance.

Another aspect of the present invention provides an electromagnetic switching device capable of restraining a generation of a gap and lengthening a life span.

According to an aspect of the present invention, there is provided an electromagnetic switching device including: a housing; fixed contacts disposed in the housing; a movable contact which is brought into contact with the fixed contacts and separated from the fixed contacts; and a driving unit disposed at one side of the housing and driving the movable contact, wherein the fixed contacts are disposed to be perpendicular to a direction in which the movable contact moves.

The fixed contacts may be disposed to be separated at one side wall of the housing or may be disposed to be separately disposed at two side walls of the housing.

The fixed contacts may include: a contact portion disposed within the housing and a connection portion extending from one side of the contact portion and disposed at an outer side of the housing.

The connection portion may be bent in a direction in which the connection portion becomes away from the driving unit.

The connection portion may be bent in a direction in which the connection portion approaches the driving unit.

The connection portion may be bent in a direction in which the connection portion approaches the driving unit and then extend to be parallel to the contact portion.

The interior of the housing includes an insulating gas.

The movable contact may be disposed to be farther from the driving unit compared with the fixed contacts.

The driving unit may include: a coil generating magnetic force; a fixed core disposed at an inner side of the coil; a movable core disposed to approach the fixed core and be separated from the fixed core; an operation rod having one side connected to the movable core and the other side connected to the movable contact; and a spring applying elastic force to allow the movable core to be separated from the fixed core, wherein the movable contact is brought into contact with the fixed contacts by the elastic force of the spring when power supply to the coil is cut off.

The movable contact may be disposed to be close to the driving unit compared with the fixed contacts.

The driving unit may include: a coil generating magnetic force; a fixed core disposed at an inner side of the coil; a movable core disposed to approach the fixed core and be separated from the fixed core; an operation rod having one side connected to the movable core and the other side connected to the movable contact; and a spring applying elastic force to allow the movable core to be separated from the fixed core, wherein the movable contact is brought into contact with the fixed contacts power is supplied to the coil.

The foregoing and other objects, features, aspects and advantages of the present invention will become more apparent from the following detailed description of the present invention when taken in conjunction with the accompanying drawings.

DETAILED DESCRIPTION OF THE INVENTION

Figure 1:
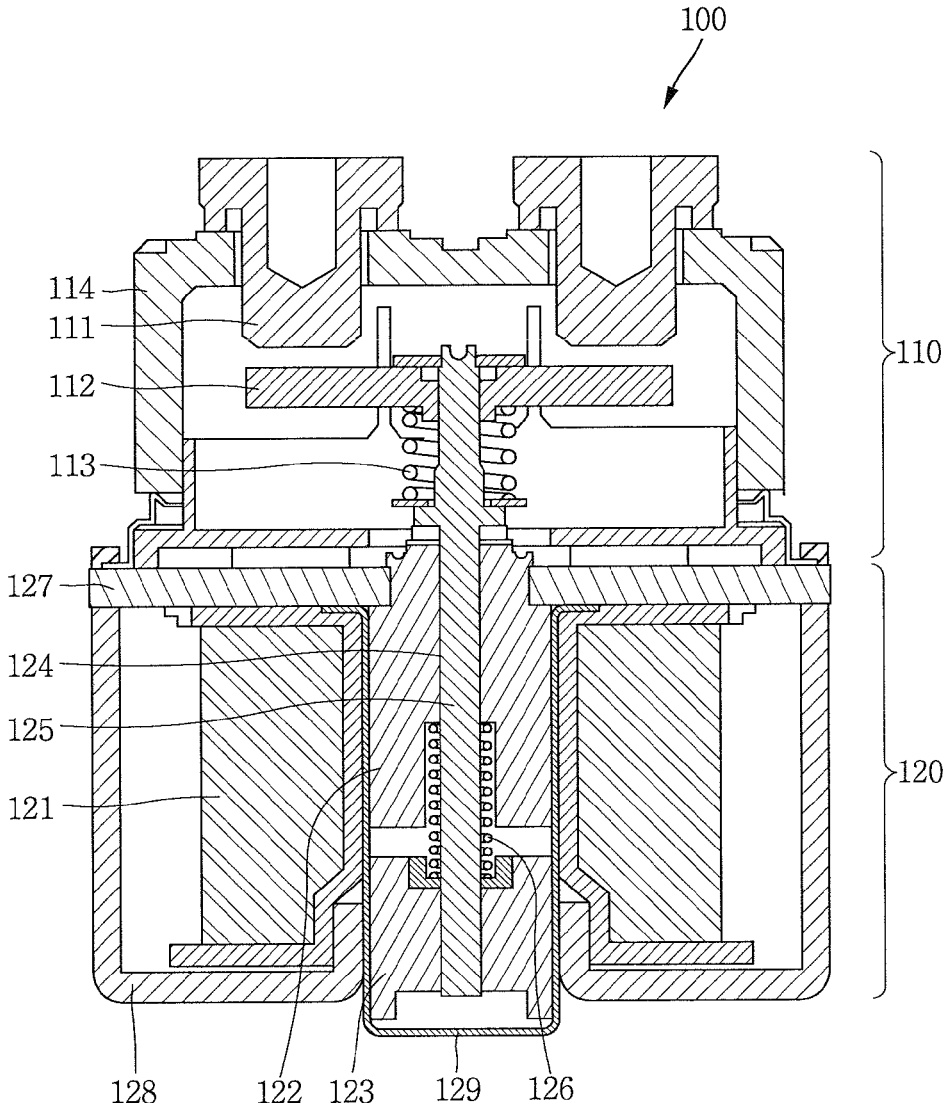
FIG. 1 RELATED ART
FIG. 1 is a sectional view of the related art electromagnetic switching device.

Embodiments of the present invention will be described in detail with reference to the accompanying drawings.

The like reference numerals will be used for the same or equivalent elements of the configurations for the sake of brevity.

Figure 2:
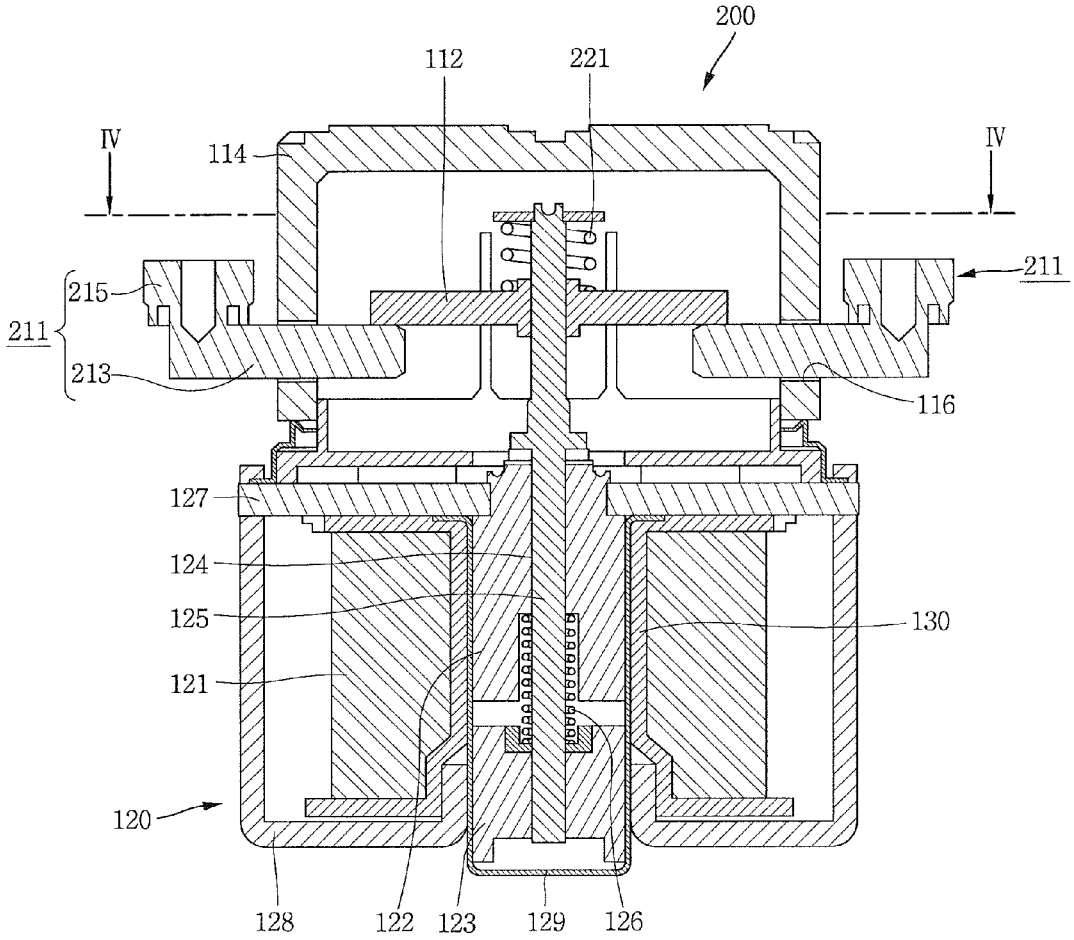
FIG. 2 is a sectional view of an electromagnetic switching device according to an embodiment of the present invention.
Figure 3:
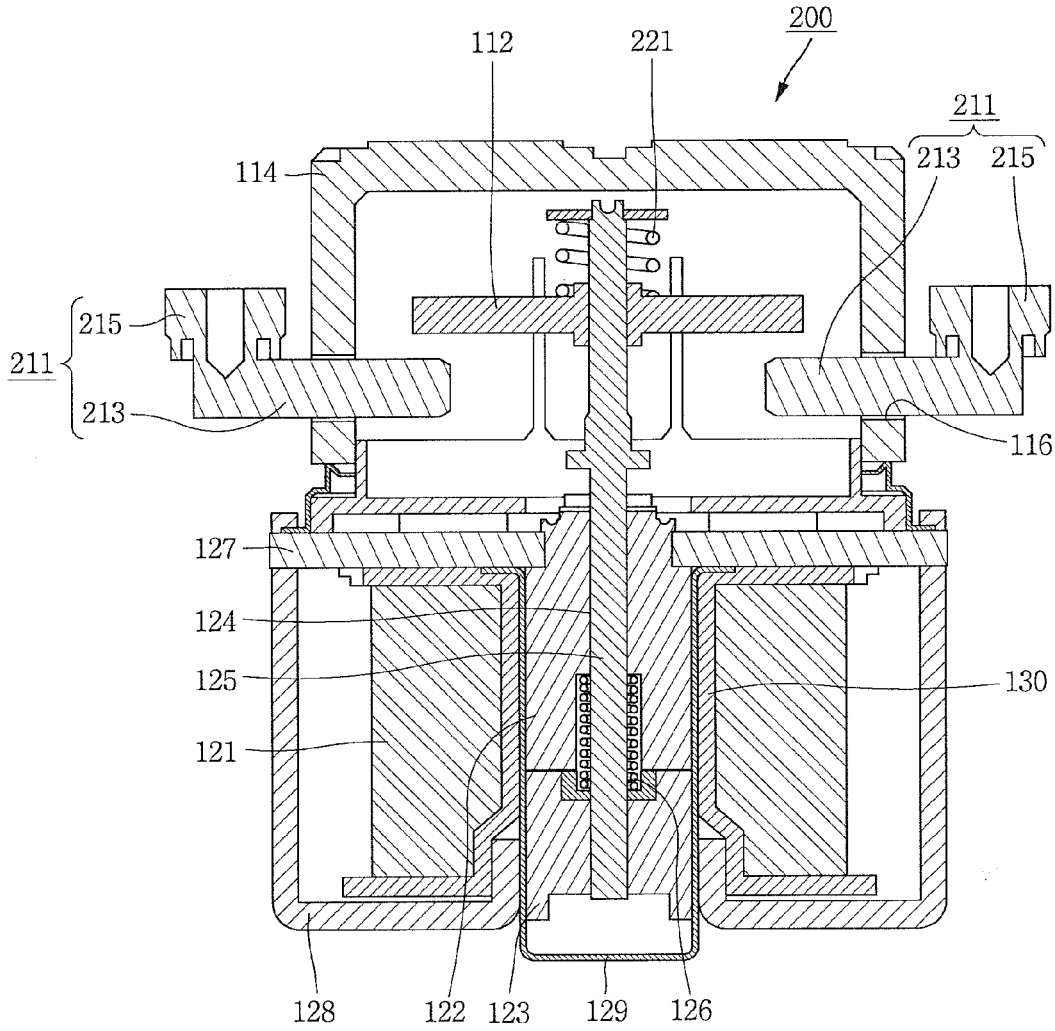
FIG. 3 is a view explaining the operation of FIG. 2.

As shown in FIGS. 2 and 3, an electromagnetic switching device 200 according to an embodiment of the present invention may include a housing 114, fixed contacts 211 disposed in the housing 114, a movable contact 112 disposed to be brought into contact with the fixed contacts and separated therefrom, and a driving unit 120 disposed at one side of the housing 114 and driving the movable contact 112.

The housing 114 may have an accommodation space therein.

For example, the housing 114 may have a shape of a rectangular parallelepiped.

The fixed contacts 211 and the movable contact 112 may be disposed to be brought into contact or separated from each other within the housing 114.

An insulating gas (not shown) may be charged in the interior of the housing 114. Accordingly, an arc generated between the fixed contacts 112 and the movable contact 112 can be quickly extinguished.

The driving unit 120 may be provided at one side (at a lower side in the drawing) of the housing 114.

The fixed contacts 211 may be provided in the housing 114.

A plurality of fixed points 211 may be configured to be spaced apart. In the present embodiment, a case in which a pair of fixed contacts 211 are provided is illustrated.

The movable contact 112 may be provided to be brought into contact with the fixed contacts 211 within the housing 114.

The fixed contacts 211 may be disposed to be perpendicular to the direction in which the movable contact 112 moves.

For example, the fixed contacts 211 may be coupled to side portions of the housing 114.

A fixed contact coupling unit 116 may be formed to allow the fixed contacts 211 to be coupled. Here, the fixed contacts 211 and the housing 114 may be integrally coupled (molded) according to insert injection molding, or the fixed contacts 211 and the housing 114 may be separately formed and assembled.

In detail, the movable contact 112 may be disposed to be movable in a vertical direction of the housing 114, and the fixed contacts 211 may be disposed in a horizontal direction of the housing 114 perpendicular to the movement direction of the movable contact 112. In the electromagnetic switching device 200 according to an embodiment of the present invention, since the fixed contacts 211 are disposed to be perpendicular to the movement direction of the housing 114, the size of an external appearance (the height of the housing 114 in the drawing) according to the movement direction of the movable contact 112 can be reduced. Also, since the fixed contacts 211 are coupled to or disposed in the housing 114 such that they are perpendicular to the movement direction of the movable contact 112, although the movable contact 112 and the fixed contacts 211 are repeatedly brought into contact with each other, a generation of a gap between the fixed contacts 211 and the housing 114 can be supressed and there is no possibility in which the fixed contacts 211 are separated from the housing 114.

Also, when the movable contact 112 comes in contact with the fixed contacts 211, the fixed contacts 211 are elastically deformed, reducing an impactive force. Accordingly, noise by impact can be reduced when the movable contact 112 is brought into contact with the contacts 211.

Figure 4:
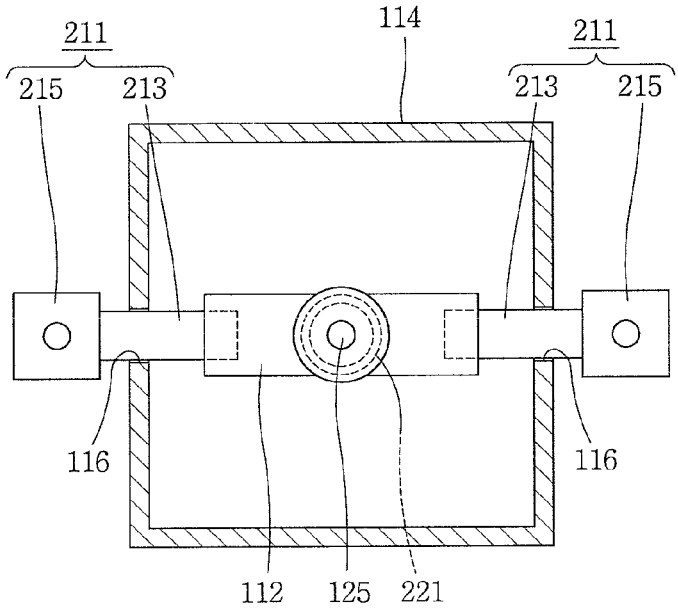
FIG. 4 is a sectional view taken along line IV-IV of FIG. 2.
Figure 5:
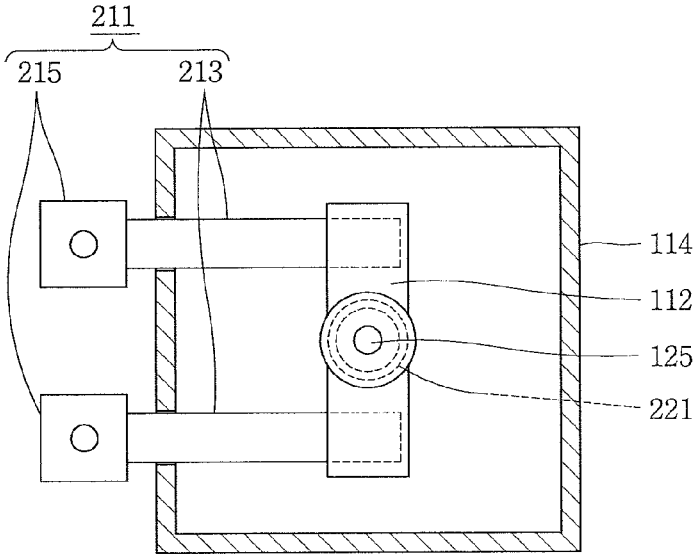
FIG. 5 is a modification of fixed contacts of FIG. 4.

As shown in FIG. 4, the fixed contacts 211 may be provided to two opposed side portions of the housing 114. Here, as shown in FIG. 5, the fixed contacts 211 may be configured to be spaced apart by a certain distance at one side portion of the housing 114. Although not shown, a coil terminal may be provided at one side of the fixed contacts 211 in order to supply power to the coil of the driving unit 120.

The fixed contacts 211 may include a contact portion 213 disposed at an inner side the housing 114, and a connection portion 215 extending from the contact portion 213 and disposed at an outer side of the housing 114, respectively. A power source is connected to one of the fixed contacts 211 and a load may be connected to the other of the fixed contacts 211.

In the present embodiment, the contact portion 213 of the fixed contacts 211 can be lengthened without increasing the size (or the height of the housing 114 in the drawing) in the movement direction of the movable contact 112. Accordingly, transmission of vibration of the fixed contacts 211 generated when the movable contact 112 is brought into contact, to the outside of the housing 114 can be reduced.

The connection portion 215 can be formed to be bent in a direction (e.g., in an upward direction in the drawing) in which the connection portion 215 is distant from the driving unit 120.

The movable contact 112 may have a bar-like shape.

The movable contact 112 may be disposed at one side of the fixed contacts 211 so as to be brought into contact with the contact portion 213 of the fixed contacts 211. For example, the movable contact 112 may be disposed at a portion farther than the fixed contacts 211 from the driving unit 120. In the present embodiment, the movable contact 112 is disposed at an upper side of the fixed contacts 211.

Meanwhile, the driving unit 120 may be configured as an electric actuator driven by electric force.

In detail, the driving unit 120 may include: a coil 121 generating magnetic force, a fixed core 122 disposed at an inner side of the coil 121, a movable core 123 disposed to approach the fixed core 122 and be separated from the fixed core 122; an operation rod 125 having one side connected to the movable core 123 and the other side connected to the movable contact 112; and a spring 126 applying elastic force to allow the movable core 123 to be separated from the fixed core 122.

The coil 121 may be wound on or around a bobbin 130.

The bobbin 130 may have a cylindrical shape.

The fixed core 122 may be disposed within the bobbin 130.

One end (upper end portion in the drawings) of the fixed core 122 may be protruded from the bobbin 130.

A yoke plate 127 constituting a magnetic path with the fixed core 122 may be coupled to an end portion of the fixed core 122.

A yoke body 128 constituting the magnetic path may be coupled to the yoke plate 127. The yoke body 128 may substantially have a cylindrical shape.

The movable core 123 may be provided within the bobbin 130 such that it can approach the fixed core 122 or separated from the fixed core 122. The movable core 123 may constitute the magnetic path with the yoke plate 127, the yoke body 128, and the fixed core 122.

One end portion of the operation rod 125 may be insertedly coupled to the movable core 123. The other end portion of the operation rod 125 may be connected to the movable contact 112 through the fixed core 122. A through hole 124 may be formed at the center of the fixed core 122, allowing the operation rod 125 to be inserted therein.

A contact spring 221 may be provided at one side of the movable contact 112 to allow the movable contact 112 to be brought into contact with the fixed contacts 211 with a certain contact pressure. The contact spring 221 may be implemented as a compressive coil spring.

Meanwhile, the spring 126 may be provided between the fixed core 122 and the movable core 123.

The spring 126 may be stretched or contracted along the movement direction of the movable core 123. The spring 126 may be implemented as a compressive coil spring. Here, the spring 126 may be configured to have elastic force stronger than that of the contact spring 221. Accordingly, when power to the coil 121 is cut off, the contact spring 221 can be compressed by the elastic force of the spring 126 and the movable contact 112 can be stably maintained to be in contact with the fixed contacts 221 with a certain contact pressure.

A can 129 may be provided at an outer side of the fixed core 122 and the movable core 123. The can may be configured to air-tightly seal the interior and the exterior of the fixed core 122 and the movable core 123.

With such a configuration, when power is applied to the coil 121 of the driving unit 120, the movable core 123 moves in a direction in which magnetic resistance is reduced, thus approaching the fixed core 122. Accordingly, the movable contact 122 is separated from the fixed contacts 211. Accordingly, the load and the power source can be separated.

Meanwhile, when power supply to the coil 121 is stopped, the movable core 123 is quickly separated from the fixed core 122 by the elastic force of the compressed spring 126. Immediately when the movable core 123 moves, the operation rod 125 moves and the movable contact 122 is brought into contact with the fixed contacts 211. Accordingly, the load is connected to the power source.

When the operation rod 125 keeps moving, the contact spring 221 is compressed to provide elastic force allowing the movable contact 122 to move toward the fixed contacts 211. Accordingly, the movable contact 122 and the fixed contacts 221 can be stably maintained in a contact state with a certain contact pressure.

An electromagnetic switching device according to another embodiment of the present invention will now be described with reference to FIGS. 6 and 7. The same reference numerals are used for the same and equivalent elements as those of the former embodiment, and a detailed description of repeated elements will be omitted.

Figure 6:
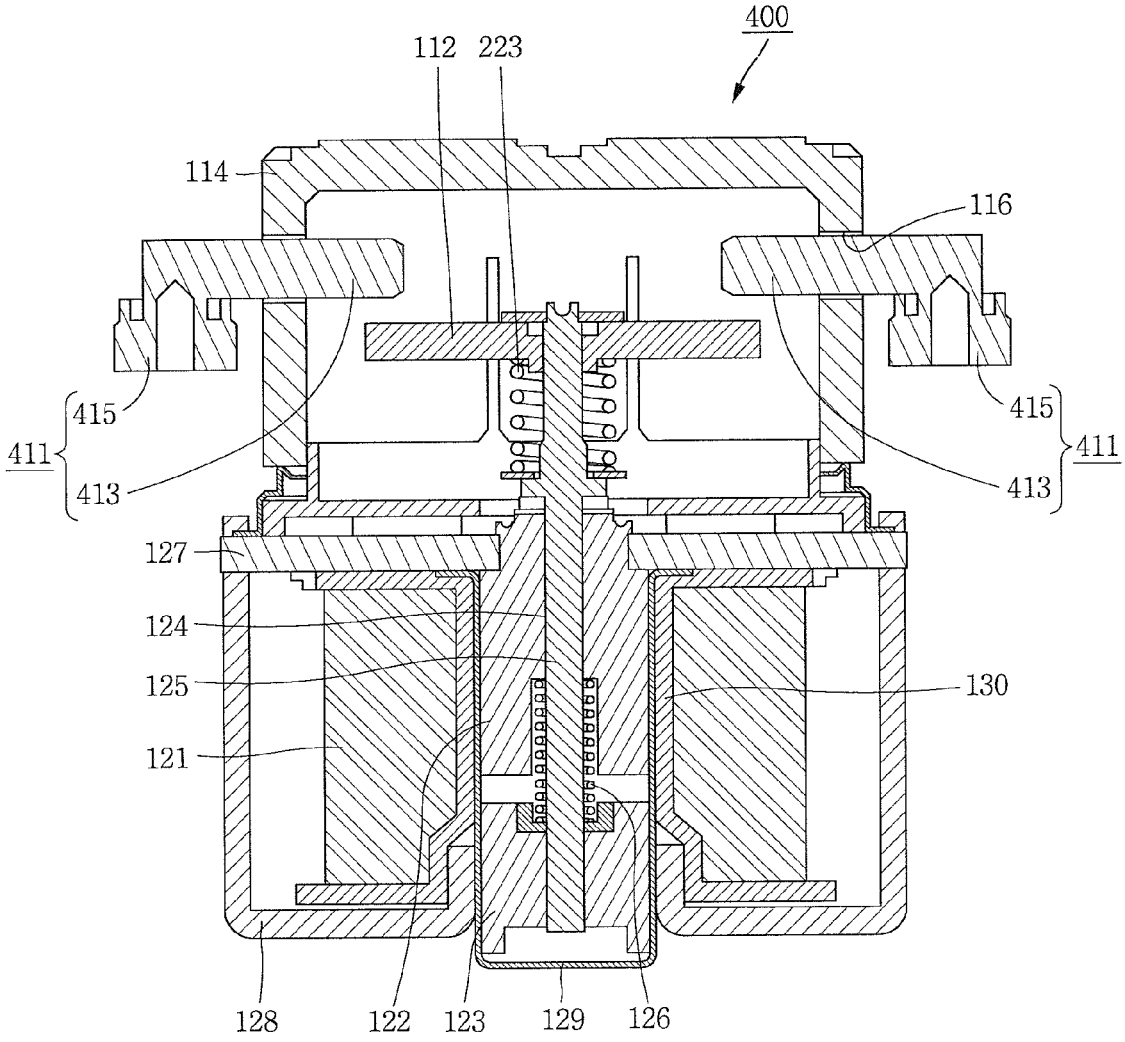
FIG. 6 is a sectional view of an electromagnetic switching device according to another embodiment of the present invention.
Figure 7:
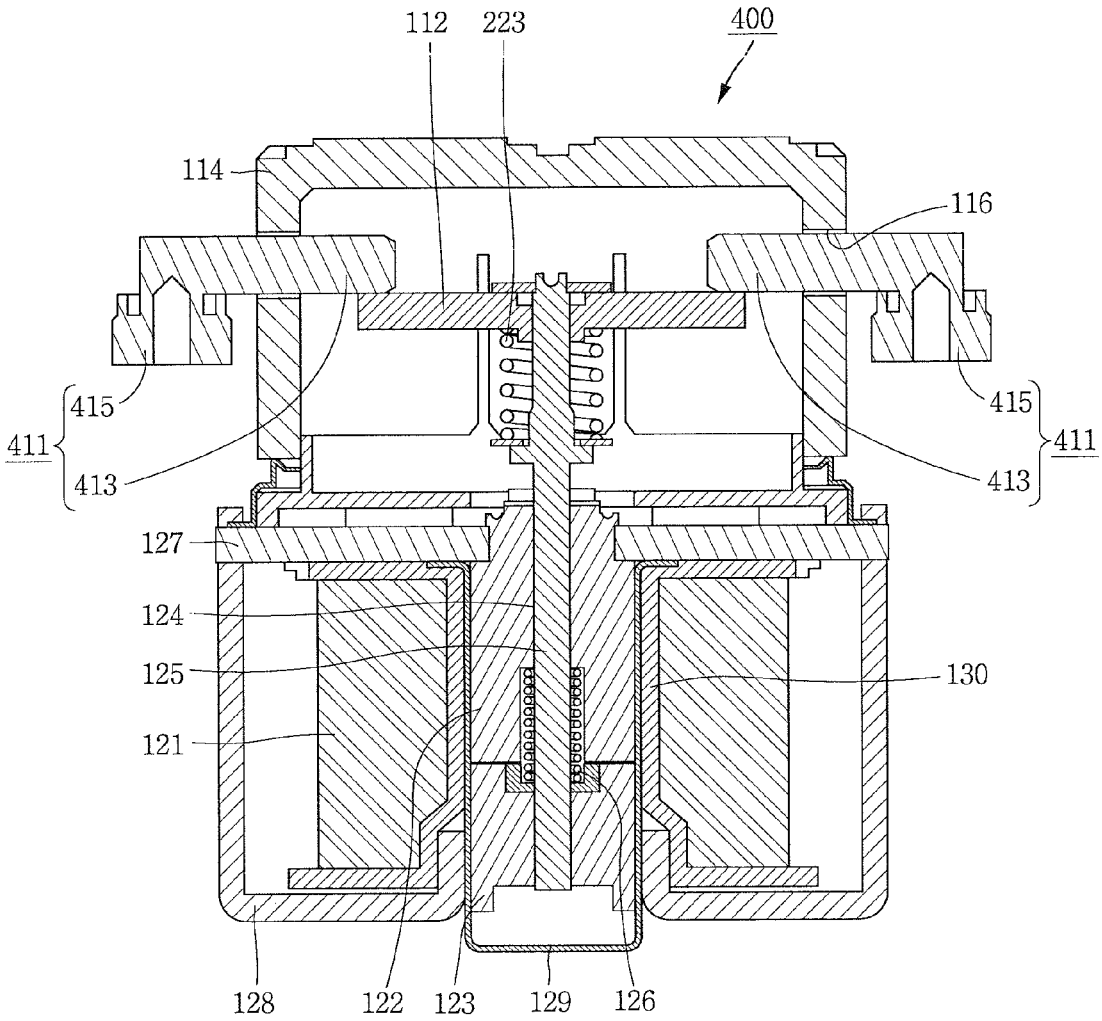
FIG. 7 is a view explaining the operation of FIG. 6.

As shown in FIGS. 6 and 7, an electromagnetic switching device 400 according to another embodiment of the present invention may include a housing 114, fixed contacts 411 disposed in the housing 114, a movable contact 112 disposed to be brought into contact with the fixed contacts 411 and separated therefrom, and a driving unit 120 disposed at one side of the housing 114 and driving the movable contact 112.

The housing 114 may include an accommodation space therein and may have a rectangular parallelepiped.

The fixed contacts 411 may be provided at side portions of the housing 114. The fixed contacts 411 may be coupled to two opposed side portions of the housing 114. Accordingly, the fixed contacts can be prevented from being protruded from the housing 114 along the movement direction of the movable contact 112 (i.e., upwardly in the drawing), thus reducing the size of the external appearance. Also, since the fixed contacts 411 are disposed to be perpendicular to the direction in which the movable contact 112 moves, a generation of a gap between the fixed contacts 411 and the housing 114 can be restrained. Also, the fixed contacts 411 can be prevented from being separated from the housing 114 due to impactive force working when the fixed contacts 411 and the movable contact 112 repeatedly come in contact.

The fixed contacts 411 may be disposed to be perpendicular to the movement direction of the movable contact 112. In detail, the fixed contacts 411 may be insertedly coupled at the sides of the housing 114. Coupling holes may be formed on the side portions of the housing 114 to allow the fixed contacts 411 to be inserted therethrough.

The fixed contacts 411 may include a contact portion 413 disposed at an inner side the housing 114, and a connection portion 415 extending from the contact portion 413 and disposed at an outer side of the housing 114, respectively. Here, the contact portion 413 may be disposed to be perpendicular to the movement direction of the movable contact 112. Namely, when the movable contact 112 moves in a vertical direction of the housing 114, the contact portion 413 may be disposed in a horizontal direction of the housing 114.

The connection portion 415 may be configured to be bent toward the driving unit 120. In the present embodiment, the connection portion 415 is bent in a downward direction.

The movable contact 112 may be disposed within the housing 114 such that it is brought into contact with the fixed contacts 411 and separated from the fixed contacts 411.

The movable contact 112 may be disposed to be closer to the driving unit 120 than the fixed contacts 411 does.

The driving unit may be configured to include the coil 121, the yoke plate 127, the fixed core 122, the movable core 123, the operation rod 125, and the sprig 126.

Here, the driving unit 120 may be configured to drive the movable contact 122 such that the movable contact 122 is brought into contact with the fixed contacts 411 when power is applied to the coil 121.

In detail, when power supply to the coil 121 is stopped, the movable core 123 is separated from the fixed core 122 by elastic force of the spring 126, and the operation rod 125 may be configured to have a length allowing the movable contact 112 is spaced apart from the fixed contacts 411 after being separated from the fixed contacts 411.

A contact sprig 223 may be provided on the operation rod 125 to pressurize the movable contact 112 toward the fixed contacts 411. Accordingly, the movable contact 112 can be brought into contact with the fixed contacts 411, with a certain contact pressure, thereby stably maintaining the contact state.

For example, the contact sprig 223 may be disposed at one side of the movable contact 112, specifically, at the side of the driving unit 120 of the movable contact 112 (or at a lower side of the movable contact 112).

In a state in which the movable contact 112 is in contact with the fixed contacts 411, the contact spring 223 pressurizes the movable contact 112 to the fixed contacts 411, whereby the movable contact 112 can be elastically in contact with the fixed contacts 411, with a certain pressure.

With such a configuration, when power is applied to the coil 121, the movable core 123 may move toward the fixed core 122. When the movable core 123 moves, the movable contact 122 moves at the same time so as to be brought into contact with the fixed contacts 411. Accordingly, the load and the power source can be connected.

Meanwhile, when power supply to the coil 121 is stopped, the movable core 123 may be separated from the fixed core 122 by the elastic force of the compressed spring 126. Accordingly, the movable contact 112 can be separated from the fixed contacts 411.

Another embodiment of the present invention will be described with reference to FIGS. 8 and 9.

Figure 8:
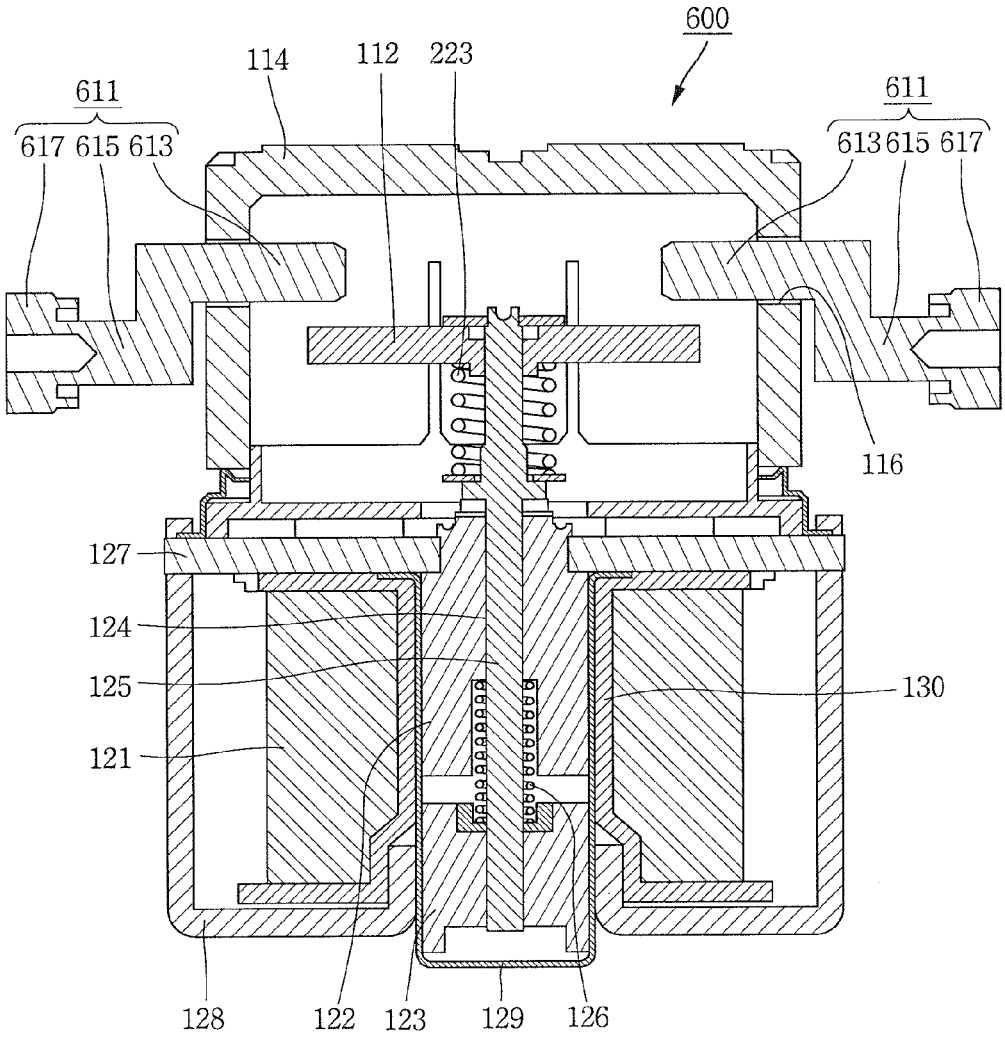
FIG. 8 is a sectional view of an electromagnetic switching device according to another embodiment of the present invention.
Figure 9:
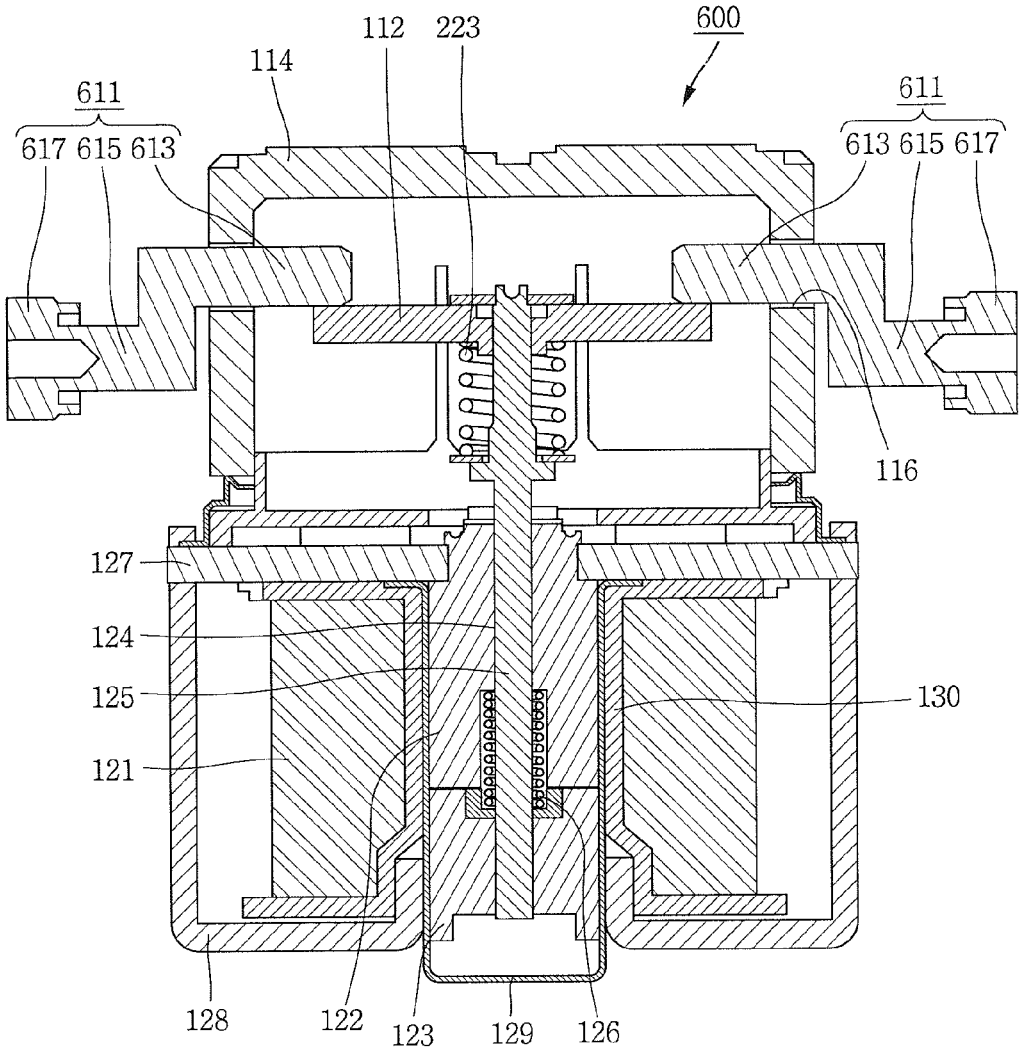
FIG. 9 is a view explaining the operation of FIG. 8.

As shown in FIGS. 8 and 9, an electromagnetic switching device 600 according to another embodiment of the present invention may include a housing 114, fixed contacts 611 disposed in the housing 114, a movable contact 112 disposed to be brought into contact with the fixed contacts 611 and separated therefrom, and a driving unit 120 disposed at one side of the housing 114 and driving the movable contact 112.

The housing 114 may include an accommodation space therein and may have a rectangular parallelepiped.

The fixed contacts 611 may be provided at the housing 114.

A plurality of fixed contacts 611 may be provided.

The fixed contacts 611 may be disposed at one side portion or at two opposed side portions of the housing 114.

The fixed contacts 611 may be disposed to be perpendicular to the movement direction of the movable contact 112. Accordingly, the size of an external appearance of the electromagnetic switching device according to the movement direction of the movable contact 112 can be reduced. Also, a generation of a gap between the housing 114 and the fixed contacts 611 due to a repeated operation (impact) of the movable contact 112 can be restrained.

Also, since contact portions 613 of the fixed contacts 611 in contact with the movable contact 112 can be formed extendedly without increasing the size of the housing 114, lessening impactive force when the movable contact 112 is brought into contact with the fixed contacts 611.

The fixed contacts 611 may include the contact portion 613 disposed at an inner side the housing 114, and a connection portion 617 extending from the contact portion 613 and disposed at an outer side of the housing 114, respectively.

One end portion of the contact portion 613 is disposed at the outer side of the housing 114, and a bent portion 615 may be provided between the contact portion 613 and the connection portion 617.

The bent portion 615 may be formed to be bent downwardly of the housing 114 from an end portion of the contact 613.

The connection portion 617 may be formed to bent to extend to outside of the housing 114 from the end portion of the bent portion 615.

The movable contact 112 may be disposed within the housing 114 such that it is brought into contact with the fixed contacts 411 and separated from the fixed contacts 411.

The movable contact 112 may be disposed to be closer to the driving unit 120 than the fixed contacts 411 does.

The driving unit may be configured to include the coil 121, the yoke plate 127, the fixed core 122, the movable core 123, the operation rod 125, and the sprig 126.

Here, the driving unit 120 may be configured to drive the movable contact 122 such that the movable contact 122 is brought into contact with the fixed contacts 411 when power is applied to the coil 121.

In detail, when power supply to the coil 121 is stopped, the movable core 123 is separated from the fixed core 122 by elastic force of the spring 126, and the operation rod 125 may be configured to have a length allowing the movable contact 112 is spaced apart from the fixed contacts 411 after being separated from the contacts 411.

A contact sprig 223 may be provided on the operation rod 125 to pressurize the movable contact 112 toward the fixed contacts 411. Accordingly, the movable contact 112 can be brought into contact with the fixed contacts 411, with a certain contact pressure, thereby stably maintaining the contact state.

For example, the contact sprig 223 may be disposed at one side of the movable contact 112, specifically, at the side of the driving unit 120 of the movable contact 112.

With such a configuration, when power is applied to the coil 121, the movable core 123 may move toward the fixed core 122. When the movable core 123 moves, the movable contact 122 moves at the same time so as to be brought into contact with the fixed contacts 411. Accordingly, the load and the power source can be connected.

Meanwhile, when power supply to the coil 121 is stopped, the movable core 123 may be separated from the fixed core 122 by the elastic force of the compressed spring 126. Accordingly, the movable contact 112 can be separated from the fixed contacts 411.

As described above, according to an embodiment of the present invention, since the fixed contacts are disposed to be perpendicular to the movement direction of the movable contact, the size of an external appearance can be reduced.

Also, since the fixed contacts are coupled to the housing such that it is perpendicular to the movement direction of the movable contact, a generation of a gap between the fixed contacts and the housing can be restrained. Also, the fixed contacts can be prevented from being separated from the housing In addition, since the movable contact is brought into contact with the side of the fixed contacts, a generation of noise due to an impact when the fixed contacts and the movable contact come in contact can be reduced.

As the present invention may be embodied in several forms without departing from the characteristics thereof, it should also be understood that the above-described embodiments are not limited by any of the details of the foregoing description, unless otherwise specified, but rather should be construed broadly within its scope as defined in the appended claims, and therefore all changes and modifications that fall within the metes and bounds of the claims, or equivalents of such metes and bounds are therefore intended to be embraced by the appended claims.

What is claimed is:

1. An electromagnetic switching device, comprising:

a housing;

a plurality of fixed contacts disposed in the housing;

a movable contact disposed in the housing and configured to contact the plurality of fixed contacts and to separate from the plurality of fixed contacts; and a driving unit disposed in the housing at one side of the housing and configured to drive the movable contact, the driving unit comprising:

a coil configured to generate a magnetic force;

a fixed core disposed at an inner side of the coil;

a movable core configured to move toward the fixed core and to move away from the fixed core;

an operation rod having one end connected to the movable core and another end connected to the movable contact; and a spring positioned between the movable core and the fixed core and configured to bias the movable core away from the fixed core and to bias the movable contact into contact with the plurality of fixed contacts when power supply to the coil is removed; and a contact spring disposed opposed to the plurality of fixed contacts with the movable contact interposed between the contact spring and the plurality of fixed contacts, and interposed between the movable contact and a plate coupled to the end portion of the operation rod connected to the movable contact, wherein the plate coupled to the end portion of the operation rod connected to the movable contact is configure to move with the operation rod, wherein the contact spring is configured to further bias the movable contact into contact with the plurality of fixed contacts, wherein the plurality of fixed contacts are disposed perpendicular to a moving direction of the movable contact, wherein one contact of the plurality of fixed contacts is configured to connect to a power source, wherein another contact of the plurality of fixed contacts is configured to connect to a load, and wherein a distance between the movable contact and the driving unit is greater than a distance between the fixed contacts and the driving unit.

2. The electromagnetic switching device of claim 1, wherein the plurality of fixed contacts are disposed separated on a single side wall of the housing or are disposed on separate side walls of the housing.

3. The electromagnetic switching device of claim 2, wherein each of the plurality of fixed contacts comprises a contact portion disposed within the housing and a connection portion extending from the contact portion and disposed at an outer side of the housing.

4. The electromagnetic switching device of claim 3, wherein the connection portion of each of the plurality of fixed contacts is bent in a direction away from the driving unit.

5. The electromagnetic switching device of claim 3, wherein the connection portion of each of the plurality of fixed contacts is bent in a direction toward the driving unit.

6. The electromagnetic switching device of claim 3, wherein the connection portion of each of the plurality of fixed contacts is bent in a direction toward the driving unit and bent again in a direction parallel to the contact portion.

7. The electromagnetic switching device of claim 1, further comprising an insulating gas in an interior of the housing.

* * * * *